US006146042A

United States Patent [19]

To et al.

[11] Patent Number: 6,146,042

[45] Date of Patent: Nov. 14, 2000

[54] SHEET RETAINING DEVICE AND METHOD OF PACKAGING SHEET RETAINING DEVICES

[75] Inventors: Chun On William To, Kowloon; Weng Io Ng, Quarry Bay, both of The Hong Kong Special Administrative Region of the People's Republic of China

[73] Assignee: World Wide Stationery Mfg. Co., Ltd., New Territories, The Hong Kong Special Administrative Region of the People's Republic of China

[21] Appl. No.: 09/098,604

[22] Filed: Jun. 17, 1998

[51] Int. Cl.[7] ..... B42F 3/04

[52] U.S. Cl. ..... 402/26; 402/31; 402/36; 402/38; 402/39; 402/41; 29/13

[58] Field of Search ..... 402/26, 31, 36, 402/38, 39, 41; 29/13

[56] References Cited

U.S. PATENT DOCUMENTS

| | | | |
|---|---|---|---|
| 5,354,142 | 10/1994 | Yu | 402/37 |
| 5,577,852 | 11/1996 | To . | |
| 5,810,500 | 9/1998 | Whaley | 402/31 |
| 5,836,709 | 11/1998 | Cheung | 402/38 |

*Primary Examiner*—A. L. Wellington
*Assistant Examiner*—Mark T Henderson
*Attorney, Agent, or Firm*—Birch, Stewart, Kolasch & Birch, LLP

[57] ABSTRACT

A sheet retaining device includes an upper member having a pair of hinged leaves supported thereby, with a plurality of ring members secured to the hinged leaves for engaging corresponding holes in sheets of material retained by the sheet retaining device. A pair of laterally spaced-apart elongated first ribs are located on the upper member and protrude outwardly from the upper member. At least one pair of laterally spaced-apart elongated second ribs protrude outwardly from the upper member and are spaced laterally outwardly from the first ribs. During shipment, the sheet retaining devices are packages together with one of the sheet retaining devices located below another of the sheet retaining devices. In this package, the ring members of the one sheet retaining device engage one or more of the ribs of the other sheet retaining device. Engagement of the ring members with the ribs minimizes damage to the sheet retaining device during transit because the ring members are positively located against or cradled by the ribs of adjacent sheet retaining devices. The ribs therefore not only reinforce the sheet retaining devices against bending, but also provide a mechanism for packaging the sheet retaining devices to prevent damage to the sheet retaining devices.

19 Claims, 10 Drawing Sheets

SHEET RETAINING DEVICE AND METHOD OF PACKAGING SHEET RETAINING DEVICES

BACKGROUND OF THE INVENTION

1. Field of the Invention

The present invention relates to a sheet retaining device for a ring binder, and more particularly, to a sheet retaining device having a plurality of longitudinally extending ribs located thereon which increase the sheet retaining device's resistance to deformation.

2. Description of the Background Art

Various ring binders are known in the art which have a paper sheet retaining device attached to a cover member by a plurality of fasteners, such as rivets 60, which extend through the cover member 62 and which are deformed, for example, by punching, to securely and permanently fix the paper retaining device to the cover member. Such an arrangement is shown in FIG. 15. The ring binder may be shipped in an assembled condition, which takes up enormous space in the packaging thereof, resulting in higher shipping costs.

Alternatively, the ring binder may be shipped in an unassembled condition with the cover members packaged separately from the sheet retaining devices for subsequent assembly by the consumer. When packing the sheet retaining devices together, a first sheet retaining device is placed directly over a second sheet retaining device such that the rings of the first sheet retaining device engage the upper member of the second sheet retaining device, and vice-versa. Typically, the upper member is simply a curved metal strip. Such an arrangement is shown in FIGS. 13 and 14.

A disadvantage associated with such packaging of conventional sheet retaining devices is that the upper members become damaged in transit. One reason is that the ring members, which are convex, are placed in contact with the upper members, which are also convex. Such an arrangement is unstable, and allows the ring members to slide on the surface of the upper members. This results in visible scratching of the surface of the upper member due to lateral sliding. Further, compressive forces placed on the upper member by the contacting ring member during transit cause the upper member to deform or dent, since the upper member is typically just a curved strip of metal with no mechanism for preventing such deformation.

As a result of such scratching and denting, the sheet retaining devices are received by the customer in an unsightly condition, and are therefore unusable. This results in waste both in an unusable product and the lost shipping costs.

Another method of shipping the sheet retaining devices is to package the sheet retaining devices with a plurality of separator strips located therebetween, as shown in FIGS. 16–25. However, the use of such separator strips creates a larger overall package, because the distance between the upper and lower sheet retaining devices is increased, as well as the overall length of the package due to the placement of the separator strips between adjacent rings of the sheet retaining device. Such wasted space is costly, and the use of the separator strips adds to the overall cost of the package and the labor involved in properly locating the separator strips between the adjacent sheet retaining devices.

SUMMARY OF THE INVENTION

It is therefore an object of the present invention to provide a sheet retaining device for a ring binder assembly which prevents or minimizes damage to the sheet retaining device during transport.

It is a further object of the present invention to provide a method of packaging sheet retaining devices such that each of the sheet retaining devices are positively located with respect to one another for preventing damage to the sheet retaining devices during transport.

It is yet another object of the present invention to provide a package of sheet retaining devices which is compact and which minimizes damage to the sheet retaining devices during transport.

It is yet still another object of the present invention to provide a package of sheet retaining devices which does not require the use of separator strips in-between, thus minimizing the overall size of the package, and reducing waste by not requiring the separator strips.

These and other objects of the present invention are achieved by a sheet retaining device comprising an upper member having a central longitudinal axis extending along a length thereof, a pair of hinged leaves supported by the upper member, a plurality of ring members secured to the hinged leaves for engaging corresponding holes in sheets of material retained by the sheet retaining device, and a pair of laterally spaced-apart elongated first ribs located on said upper member and extending along the longitudinal axis thereof, the first ribs protruding outwardly from the upper member.

The objects of the present invention are further achieved by a method of packaging a plurality of sheet retaining devices comprising the steps of providing a plurality of sheet retaining devices, each sheet retaining device having an upper member having a central longitudinal axis extending along a length thereof, a pair of hinged leaves supported by the upper member, a plurality of ring members secured to the hinged leaves for engaging corresponding holes in sheets of material retained by the sheet retaining device, and a plurality of elongated ribs located on the upper member and extending along the longitudinal axis thereof, the ribs protruding outwardly from the upper member, and locating a first of said sheet retaining devices below a second of said sheet retaining devices such that the ring members of the second sheet retaining device engage at least one of the ribs of the first sheet retaining device.

The objects of the present invention are additionally achieved by a package of sheet retaining devices, each sheet retaining device having an upper member having a central longitudinal axis extending along a length thereof, a pair of hinged leaves supported by the upper member, a plurality of ring members secured to the hinged leaves for engaging corresponding holes in sheets of material retained by the sheet retaining device, and a plurality of elongated ribs located on the upper member and extending along the longitudinal axis thereof, the ribs protruding outwardly from the upper member, and a first of the sheet retaining devices being located below a second of the sheet retaining devices such that the ring members of the second sheet retaining device engage at least one of the ribs of the first sheet retaining device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
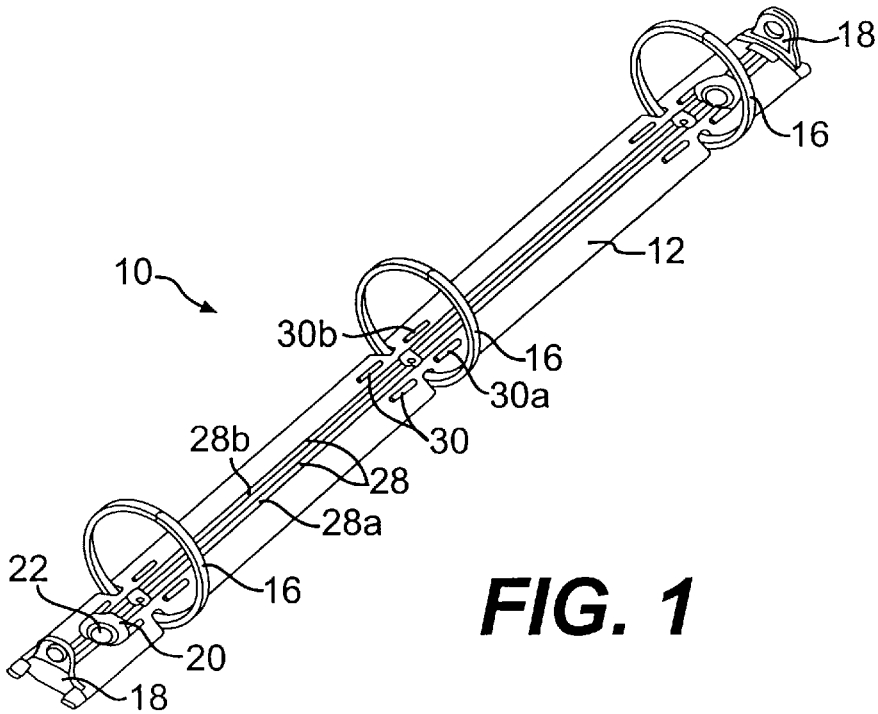
FIG. 1 is a perspective view of a first embodiment of the sheet retaining device of the present invention showing a plurality of ribs thereon.
Figure 2:
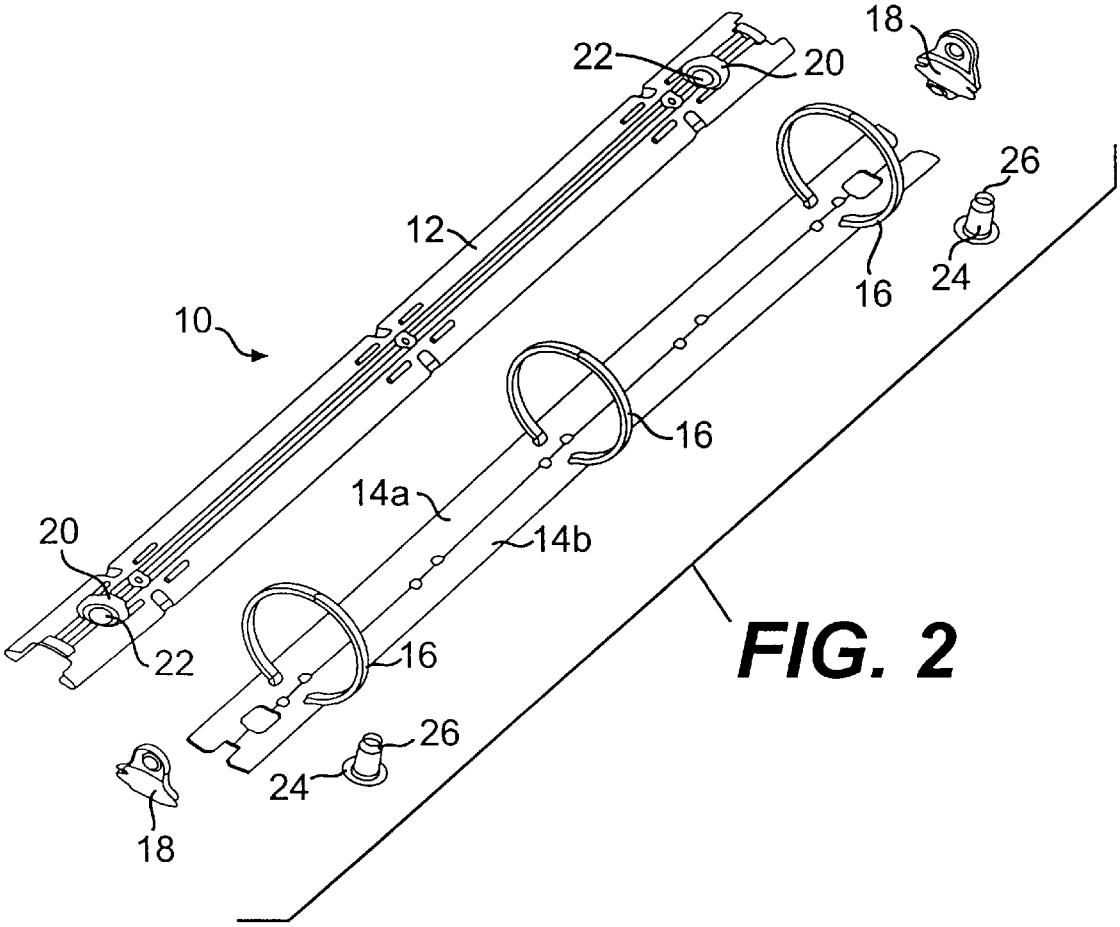
FIG. 2 is an exploded perspective view of the sheet retaining device showing the respective elements.

Referring in detail to the drawings, and with particular reference to FIGS. 1 and 2, a sheet retaining device 10 of the present invention is shown. The sheet retaining device 10 is securable to a cover member (not shown) to produce a ring binder.

Figure 7:
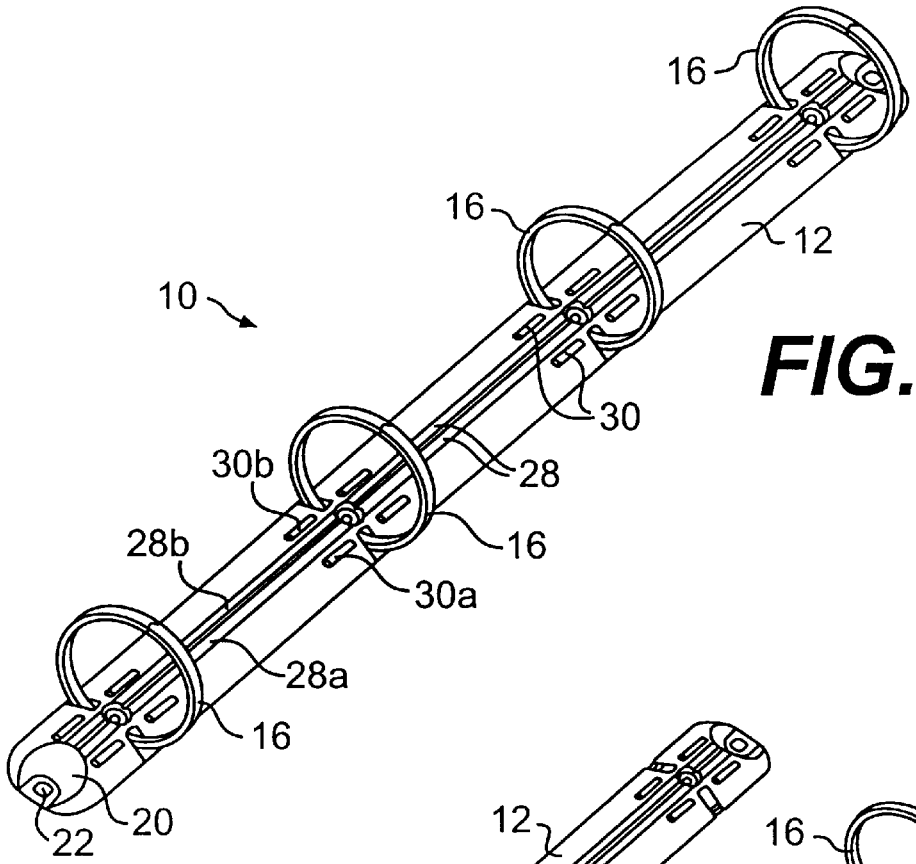
FIG. 7 is a perspective view of a second embodiment of the sheet retaining device of the present invention showing a plurality of ribs thereon.
Figure 8:
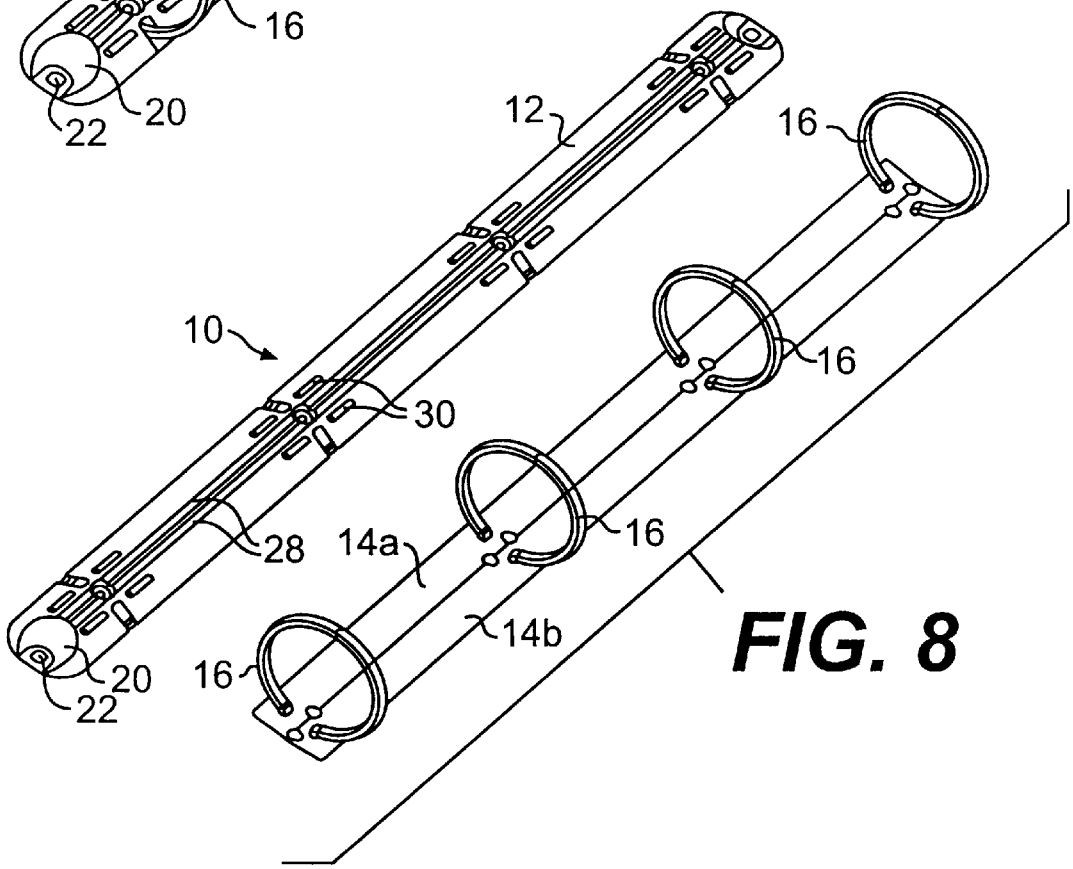
FIG. 8 is an exploded perspective view of the sheet retaining device of FIG. 7 showing the respective elements.
Figure 9:
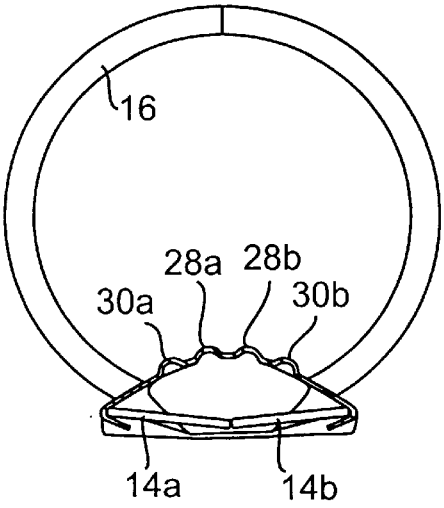
FIG. 9 is a cross-sectional end view of the sheet retaining device of FIG. 7.
Figure 10:
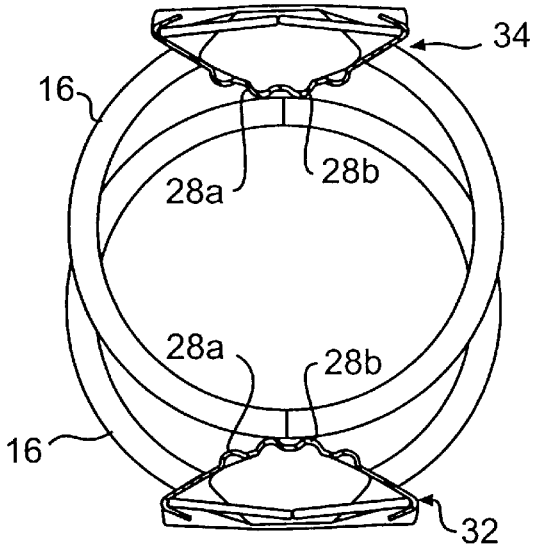
FIG. 10 is a cross-sectional end view showing a first packaging arrangement with one sheet retaining device of FIG. 7 located directly above a second sheet retaining device.
Figure 11:
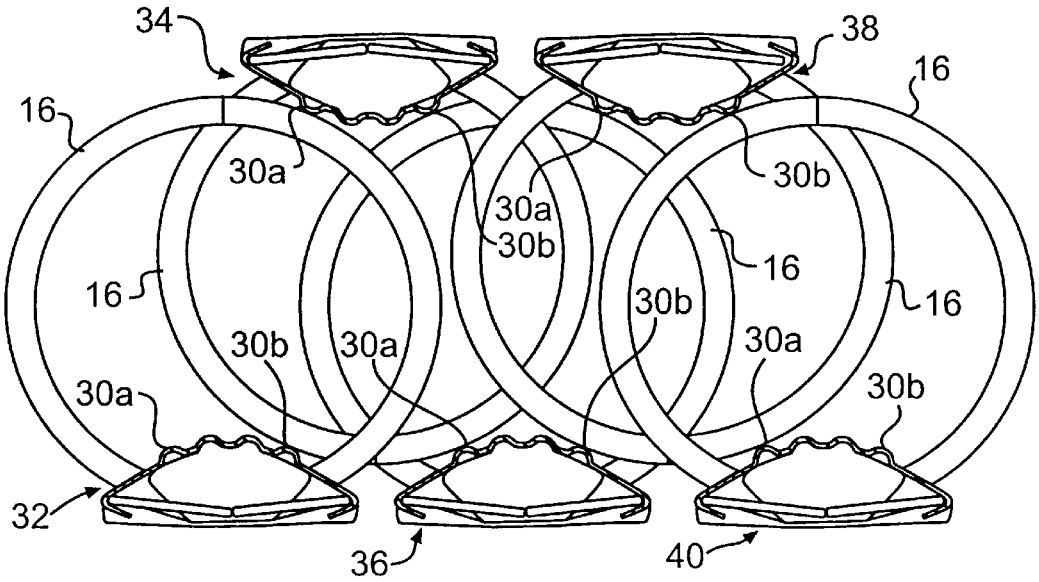
FIG. 11 is a cross-sectional end view showing a second packaging arrangement with each sheet retaining device of FIG. 7 located offset with respect to adjacent sheet retaining devices.
Figure 13:
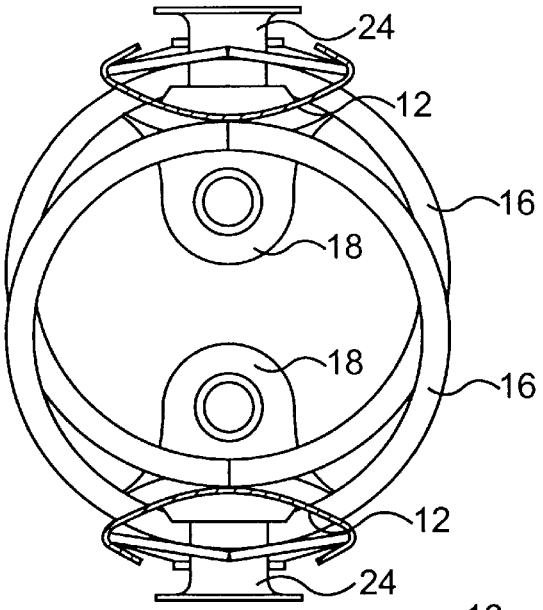
FIG. 13 BACKGROUND ART
FIGS. 13 and 14 are cross-sectional end views of the sheet retaining devices of the background art without ribs.
Figure 14:
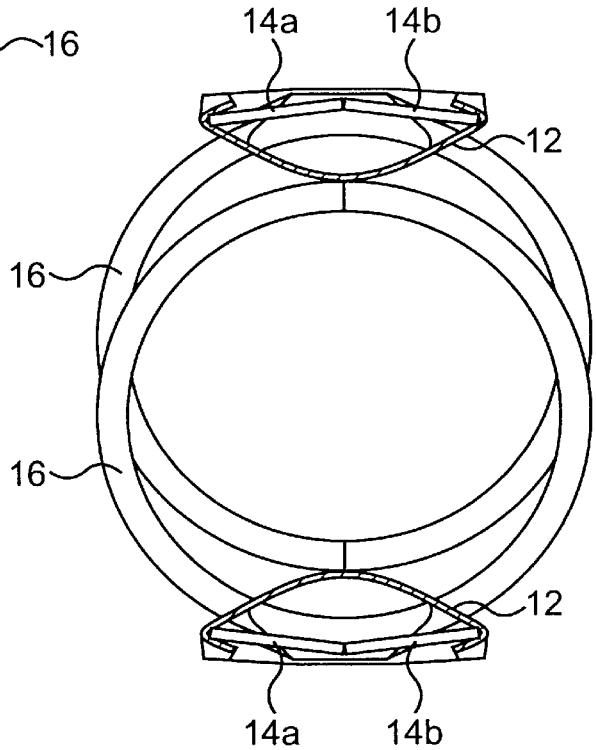
FIG. 14 BACKGROUND ART

The sheet retaining device 10 includes a substantially rigid curved upper plate 12 supporting a pair of hinged leaves 14*a*, 14*b*. Secured to the hinged leaves 14*a*, 14*b* are a plurality of ring members 16 for engaging corresponding holes in sheets of material retained by the sheet retaining device 10. Although three ring members 16 are shown in FIGS. 1 and 2, it should be understood that any number and arrangement of ring members 16 may be utilized. For example, four ring members are shown in the embodiment of FIGS. 7 and 8, which will be described in more detail later. The ring members 16 may be equally spaced-apart, or may have different spacings.

A lever 18 is located at each end of the curved upper plate 12 for actuating the hinged leaves 14*a*, 14*b* to open and close the ring members 16 in a conventional manner.

Figure 15:
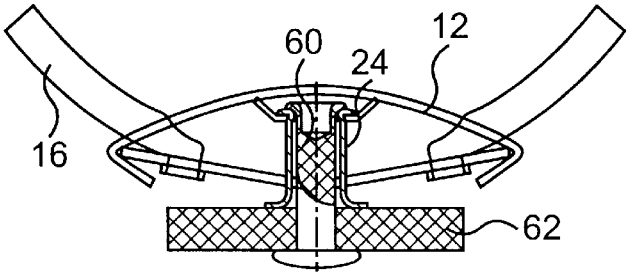
FIG. 15 BACKGROUND ART
FIG. 15 is a cross-sectional end view showing a sheet retaining device attached to a cover member by a rivet of the background art.
Figure 16:
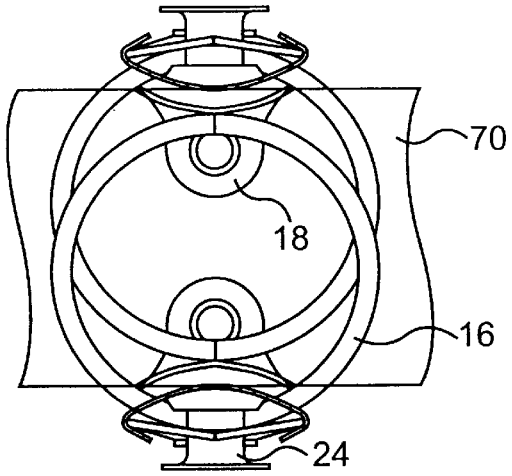
FIG. 16 BACKGROUND ART
FIG. 16 is an end view of a packaging arrangement of the background art which utilizes separator strips.
Figure 18:
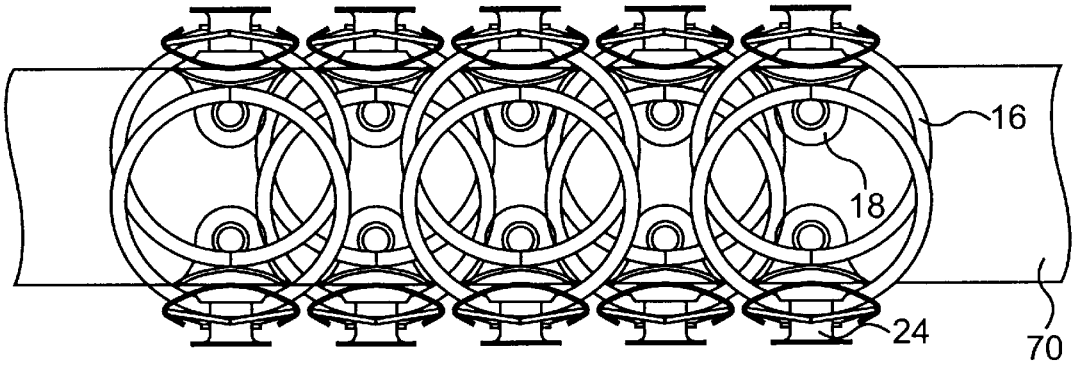
FIG. 18 BACKGROUND ART
FIGS. 18 and 19 are end views of alternative packaging arrangements of the background art which utilize separator strips.
Figure 19:
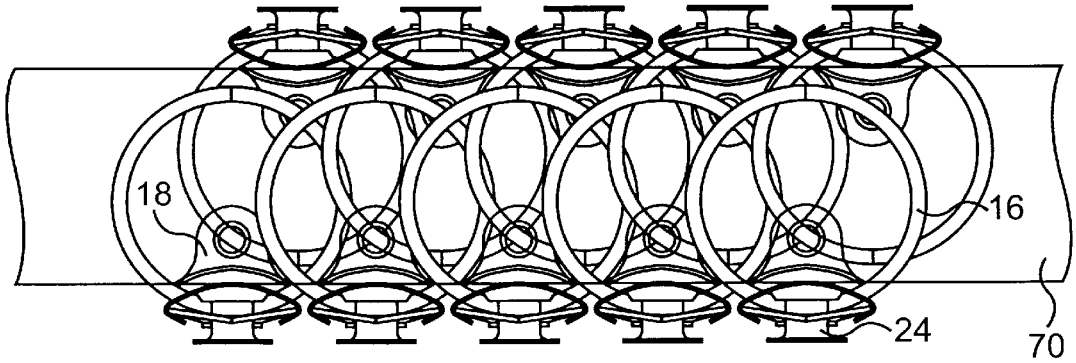
FIG. 19 BACKGROUND ART
Figure 17:
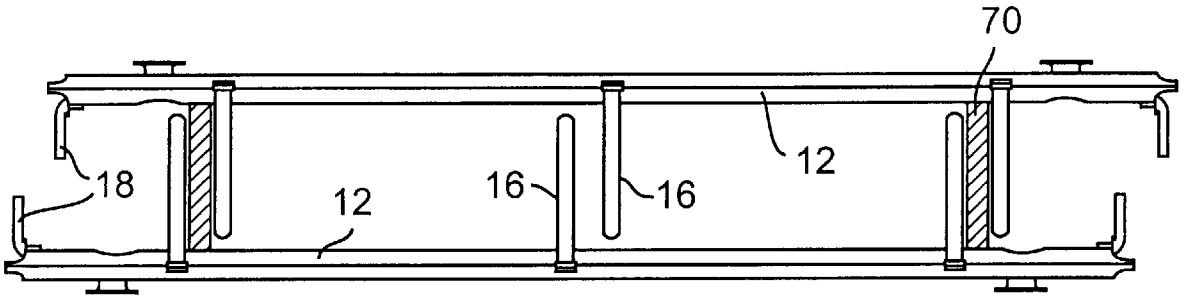
FIG. 17 BACKGROUND ART
FIG. 17 is a side view of the packaging arrangement utilizing separator strips of FIG. 16.
Figure 20:
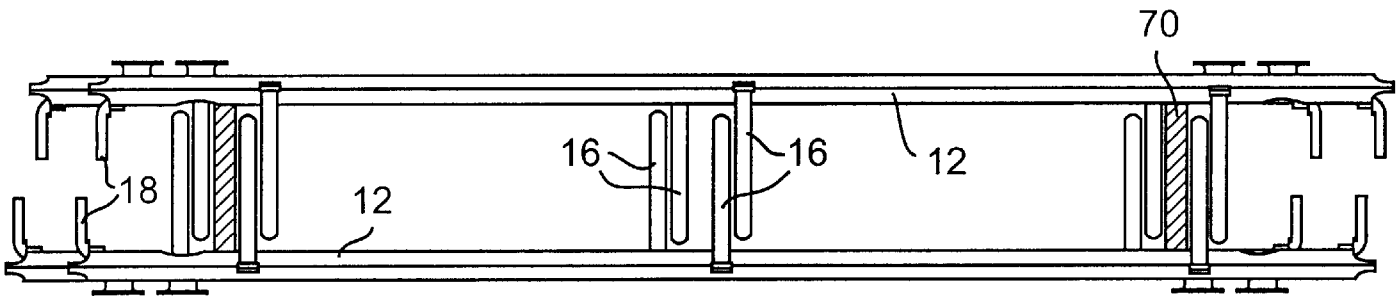
FIG. 20 BACKGROUND ART
FIG. 20 is a side view of the packaging arrangement shown in FIGS. 18 and 19.
Figure 21:
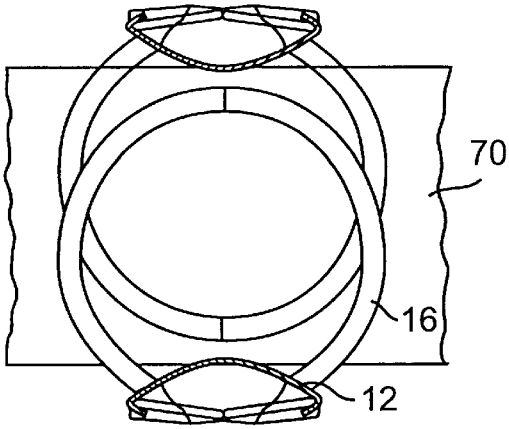
FIG. 21 BACKGROUND ART
FIG. 21 is another packaging arrangement which utilizes the second embodiment of the sheet retaining apparatus separated by separator strips.
Figure 23:
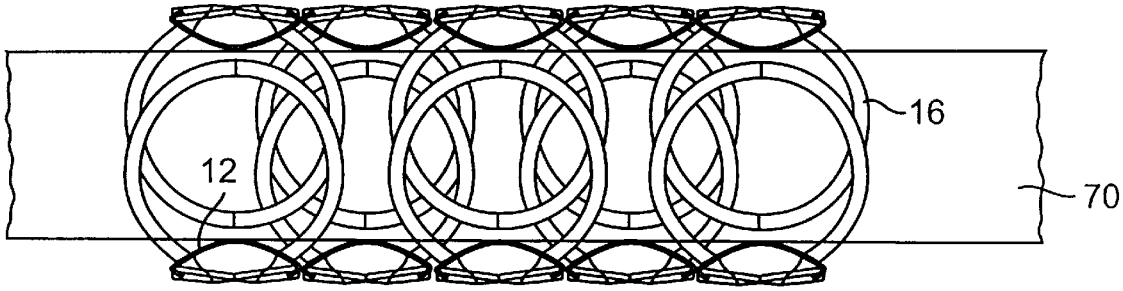
FIG. 23 BACKGROUND ART
FIGS. 23 and 24 are other packaging arrangements of the background art which utilize separator strips.
Figure 24:
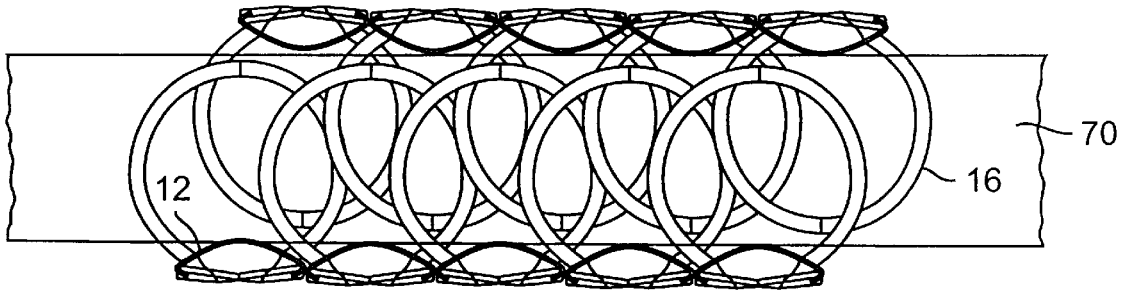
FIG. 24 BACKGROUND ART
Figure 22:
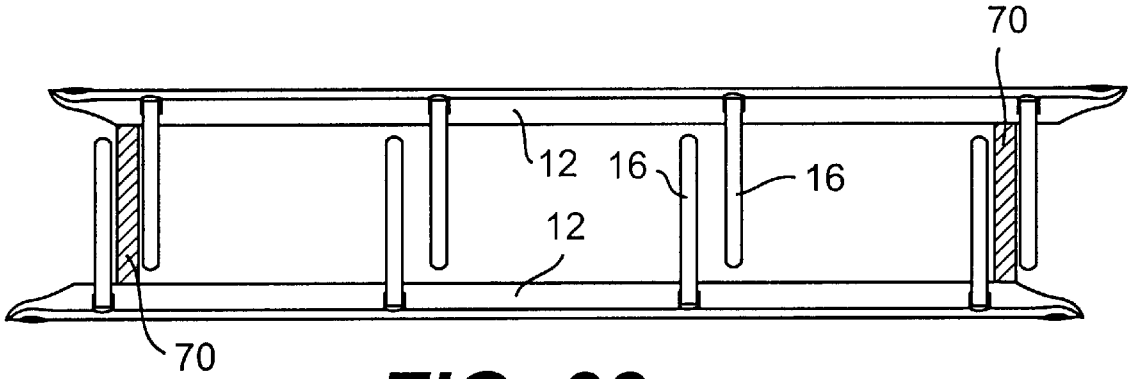
FIG. 22 BACKGROUND ART
FIG. 22 is a side view of the packaging arrangement shown in FIG. 21.
Figure 25:
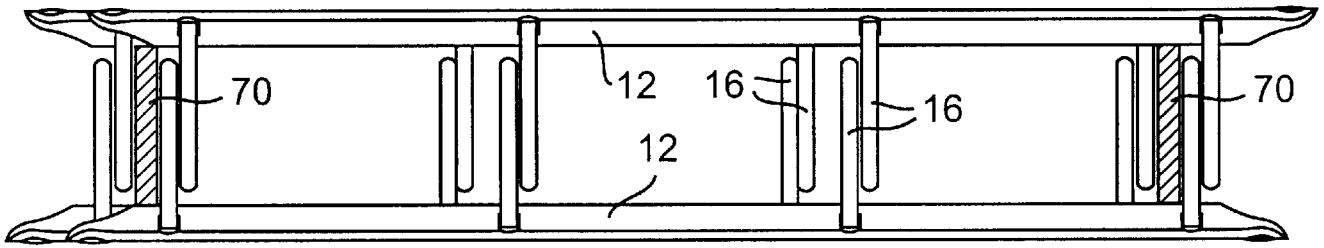
FIG. 25 BACKGROUND ART
FIG. 25 is a side view of the packaging arrangements shown in FIGS. 23 and 24.

The curved upper plate 12 includes a depression 20 near each end thereof. The depression 20 includes an aperture 22 extending through the upper plate 12. A post 24 is utilized to elevate the sheet retaining device 10 slightly above the cover member in a well known manner. The post 24 is inserted through the aperture 22 in the upper plate 12. The upper portion 26 of the post 24 is deformed outwardly to become larger than the diameter of the aperture 22, thereby securing the post 24 to the sheet retaining device 10. A rivet (not shown) may then be inserted through an aperture in the spine of the cover member and through an aperture in the post 24, and the head of the rivet may then be deformed to secure the sheet retaining device to the cover member, such as shown in FIG. 15. These and other aspects of the sheet retaining device 10 are more fully disclosed in U.S. Pat. No. 5,354,142, the entire contents of which are hereby incorporated by reference.

The upper plate 12 includes a pair of first ribs 28 which protrude upwardly and outwardly from an outer surface of the upper plate 12. The first ribs 28 comprise laterally spaced-apart first rib members 28*a*,28*b* located symmetrically with respect to a longitudinal axis which extends centrally along the length of the upper plate 12. The first ribs 28 are elongated in a direction along the length of the upper plate 12 and extend substantially along the entire length of the upper plate 12 from one end to another.

The upper plate 12 further includes several pairs of second ribs 30 which are located on opposite longitudinal sides of the ring members 16. The number of pairs of second ribs 30 is preferably twice the number of ring members 16. In this embodiment, six pairs of second ribs 30 are utilized for three ring members 16.

Figure 5:
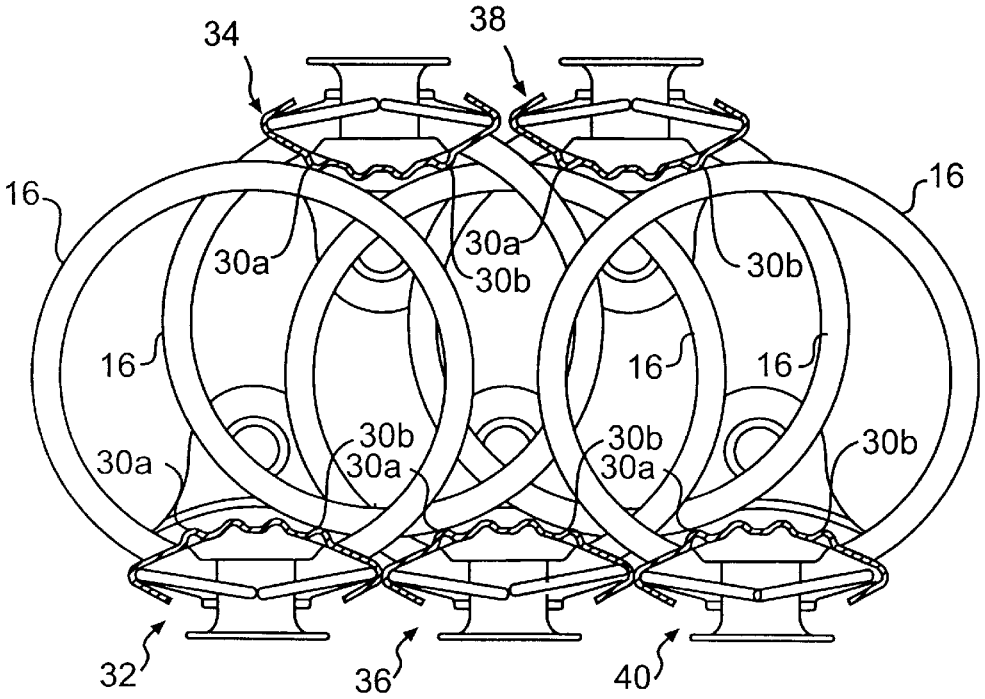
FIG. 5 is a cross-sectional end view showing a second packaging arrangement with each sheet retaining device located offset with respect to adjacent sheet retaining devices.

The second ribs 30 protrude upwardly and outwardly from an outer surface of the upper plate 12. The second ribs 30 comprise laterally spaced-apart second rib members 30*a*,30*b* located laterally with respect to and preferably laterally outwardly of the first rib members 28*a*,28*b*, respectively. The second ribs 30 are located symmetrically with respect to the longitudinal axis of the upper plate 12. The second ribs 30 are elongated in a direction along the length of the upper plate 12 and preferably extend for a distance much shorter than the first ribs 28. In other words, two short segments of second ribs 30 are located between each of the ring members 16 which do not extend from one ring member 16 to another. The second ribs are long enough that when multiple sheet retaining devices are packaged as shown in FIG. 5, the ring members 16 will contact the ribs 30*a* or 30*b* when offset. However, it is conceived that the second ribs 30 could extend continuously between each of the ring members 16.

Figure 3:
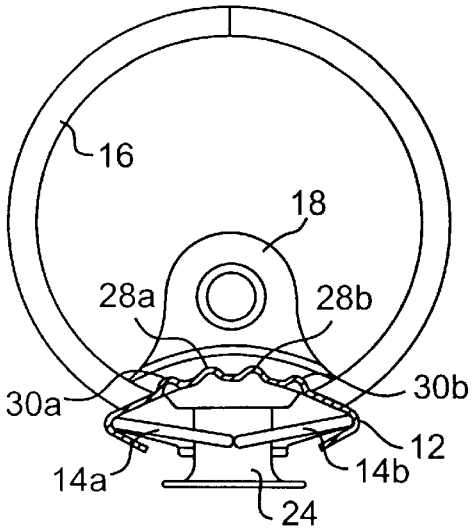
FIG. 3 is a cross-sectional end view of the sheet retaining device.

Referring now to FIG. 3, a cross-sectional view through the first and second ribs 28,30 is shown. The ribs 28,30 are formed integrally as a portion of the upper member 12 which is deformed during manufacture to produce the ribs 28,30 which protrude from the top surface of the upper member 12.

Figure 4:
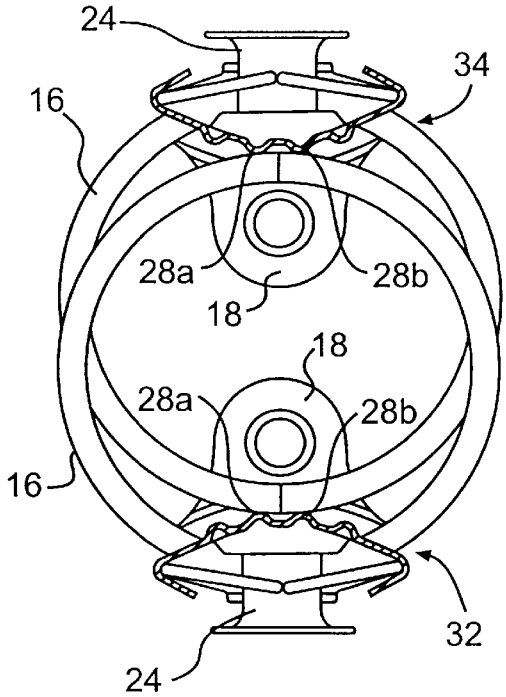
FIG. 4 is a cross-sectional end view showing a first packaging arrangement with one sheet retaining device located directly above a second sheet retaining device.
Figure 6:
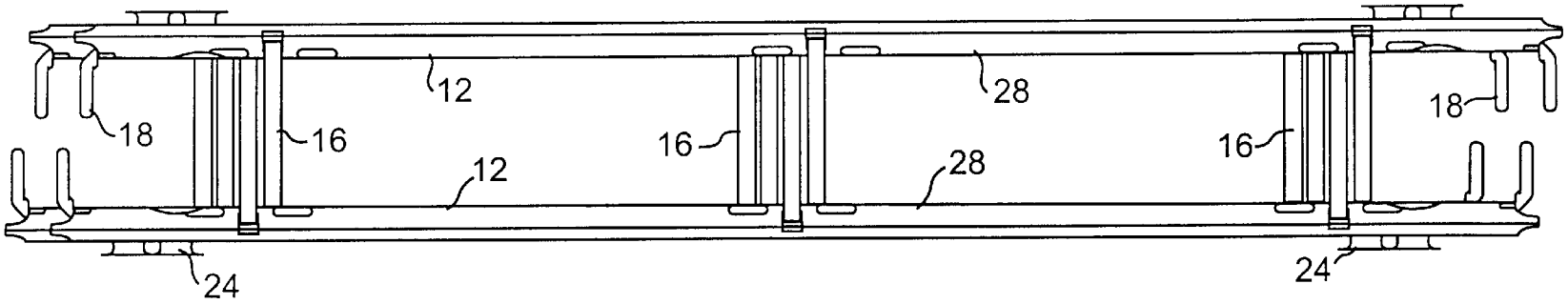
FIG. 6 is a side view of the second packaging arrangement shown in FIG. 5.
Figure 12:
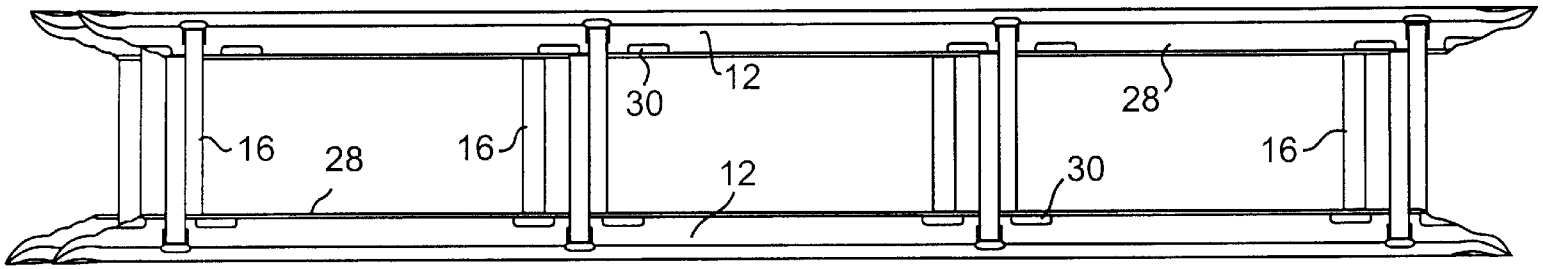
FIG. 12 is a side view of the second packaging arrangement shown in FIG. 11.

The location and placement of the first and second ribs 28,30 allows accurate placement of other sheet retaining devices thereagainst during packing of the sheet retaining devices for shipment. As shown in FIGS. 4, 5 and 6, two or more sheet retaining devices are located one atop another to form a package for transport. The sheet retaining devices may be packaged with one directly above another as shown in FIG. 4, or in an interleaved manner where the upper sheet retaining devices are located approximately halfway between the lower sheet retaining devices, as shown in FIGS. 5 and 6.

Referring now to FIG. 4, a first packaging arrangement is shown wherein a first sheet retaining device 32 is located directly below a second sheet retaining device 34. The ring members 16 of the first sheet retaining device 32 engage the pair of first ribs 28 on the upper plate 12 of the second sheet retaining device 34. Preferably, the ring members 16 of the second sheet retaining device 34 also engage the pair of first ribs 28 on the upper plate 12 of the first sheet retaining device 32. However, dimensional tolerances and manufacturing constraints may prevent every ring member 16 from engaging each of the first ribs 28. Nevertheless, at least two ring members 16 should be in contact with the first ribs 28 to securely position the sheet retaining devices with respect to one another.

Referring now to FIGS. 5 and 6, a second packaging arrangement is shown wherein a third sheet retaining device 36 is located beside the first sheet retaining device 32. A second sheet retaining device 34 is positioned above and between the first and third sheet retaining devices 32,36 such that the ring members 16 of the second sheet retaining device 34 engage the second ribs 30 on the first sheet retaining device 32, and also engage the second ribs 30 on the third sheet retaining device 36. More particularly, the ring members 16 of the second sheet retaining device 34 engage the second rib members 30*b* on the first sheet retaining device 32, and also engage the second rib members 30*a* on the third sheet retaining device 36.

Preferably, the ring members 16 of the first sheet retaining device 32 also engage the second rib members 30*a* on the upper plate 12 of the second sheet retaining device 34, and the ring members 16 of the third sheet retaining device 36 also engage the second rib members 30*b* on the upper plate 12 of the second sheet retaining device 34. However, as set forth above, dimensional tolerances and manufacturing constraints may prevent every ring member 16 from engaging each of the second ribs 30. Nevertheless, at least two ring members 16 should be in contact with the second ribs 30 to securely position the sheet retaining devices with respect to one another.

The ring members 16 of the second sheet retaining device 34 may engage both the first and second ribs 28,30 on the first sheet retaining device 32, and also engage both the first and second ribs 28,30 on the third sheet retaining device 36. More particularly, depending on the size of the ring members 16 and the ribs 28,30, the ring members 16 of the second sheet retaining device 34 may simultaneously engage the first rib member 28*b* and the second rib members 30*b* on the first sheet retaining device 32, and also engage the first rib member 28*a* and the second rib members 30*a* on the third sheet retaining device 36.

Additional sheet retaining devices can be located beside the second and third sheet retaining devices 34,36 to form a package having any number of sheet retaining devices. For example, as shown in FIG. 5, a fourth sheet retaining device 38 is located beside the second sheet retaining device 34, and a fifth sheet retaining device 40 is located beside the third sheet retaining device 36. The ring members 16 of the fourth and fifth sheet retaining devices 38,40 engage the second ribs 30 of the corresponding adjacent sheet retaining device in the manners described above with respect to the first, second and third sheet retaining devices 32,34,36.

In each of the packaging arrangements shown in FIGS. 4–6, the first and second ribs 28,30 positively locate the ring members 16 against the ribs 28,30 for preventing damage to the upper plate 12 of the sheet retaining device during transport. The first and second ribs 28,30 increase the resistance of the upper plate 12 to deformation by the ring members 16 of an adjacent sheet retaining device 10. Further, the first and second ribs 28,30 reinforce the upper plate 12, thereby increasing the resistance of the upper plate 12 to bending. In order to minimize the size of the box that a given number of sheet retaining devices can be packaged in a given size package, the individual ring members 16 of adjacent sheet retaining devices 10 should be arranged immediately adjacent to and in contact with corresponding ring members 16 of adjacent sheet retaining devices 10. This allows the package such as a box that the sheet retaining devices 10 will be packaged in to have a length (measured along the length of the sheet retaining device 10) that is as long as an individual sheet retaining device 10 plus the thickness of three additional ring members 16. For example, as shown in FIG. 5, the ring members 16 of the sheet retaining devices 34, 36 and 38 overlap with the ring members 16 of the sheet retaining device 32. Thus, sheet retaining devices 32, 34, 36 and 38 will all be longitudinally offset with respect to each other. However, since the ring members 16 of the sheet retaining device 32 do not interfere with the ring members 16 of the sheet retaining device 40, the ring members 16 of these two sheet retaining devices can be and preferably are in the same plane or they are not offset with respect to each other.

This package arrangement also minimizes slippage of the sheet retaining devices during shipment and assures that all ring members will contact the short ribs 30*a* and 30*b* of adjacent (and opposed) sheet retaining devices. Slippage is particularly minimized when movement of the individual sheet retaining devices in a packaged construction is minimized by making the box in which they are packaged just long enough to accommodate the packaged combination or by restricting movement by use of packaging material, rubber bands or any other device which would restrain movement. The sheet retaining devices can be packaged in a rigid package such as a box or a flexible package such as a plastic box or shrink wrap. However, restricting movement of the sheet retaining devices is merely an optional feature of the invention.

Referring now to FIGS. 7–12, a second embodiment of the present invention is shown. The same reference numerals which were used in the first embodiment are used in the second embodiment to designate identical or similar features and elements.

The second embodiment is similar to the first embodiment of FIGS. 1–6 except that the second embodiment does not include a lever 18 for operating the ring members 16. Also, the ends of upper plate 12 in the second embodiment are shaped differently than the ends of the upper plate 12 in the first embodiment, and the second embodiment does not utilize the posts 24. Finally, the second embodiment uses four ring members 16, whereas the first embodiment shows three ring members 16.

The description set forth previously with respect to the first embodiment is equally applicable to the remainder of the second embodiment. For example, the second embodiment of FIGS. 7–12 includes first and second ribs 28,30 which are located and function in the same manner as the ribs 28,30 of the first embodiment shown in FIGS. 1–6 described above. Also, the manner of packaging the sheet retaining devices of the second embodiment is the same as the manner of packaging the sheet retaining devices of the first embodiment.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A sheet retaining device for a ring binder assembly, the sheet retaining device comprising:

an upper member having a central longitudinal axis extending in a first direction along a length thereof;

a pair of hinged leaves supported by said upper member;

a plurality of ring members secured to said hinged leaves for engaging corresponding holes in sheets of material retained by the sheet retaining device;

a pair of laterally spaced-apart elongated first ribs located on said upper member and extending in said first direction along said upper member, said first ribs protruding outwardly from said upper member to form a trough therebetween; and at least one pair of laterally spaced-apart elongated second ribs protruding outwardly from said upper member and extending in said first direction along said upper member, said second ribs being spaced laterally outwardly from said first ribs, wherein said first ribs are positioned on said upper member for engagement by ring members of a second sheet retaining device located thereagainst for packaging in a first arrangement, and wherein said second ribs are positioned on said upper member for engagement by ring members of a second sheet retaining device located thereagainst for packaging in a second alternative arrangement.

2. The sheet retaining device as set forth in claim 1, wherein said ribs increase resistance of the upper member to deformation by said ring members of said second sheet retaining device.

3. The sheet retaining device as set forth in claim 1, wherein said first ribs are located symmetrically about said central longitudinal axis.

4. The sheet retaining device as set forth in claim 1, wherein each of said first ribs extends along substantially an entire length of said upper member.

5. The sheet retaining device as set forth in claim 1, further comprising a plurality of pairs of said second ribs, each pair of said second ribs being located on opposite longitudinal sides of said ring members.

6. The sheet retaining device as set forth in claim 1, wherein said second ribs are located symmetrically about said central longitudinal axis.

7. A method of packaging a plurality of sheet retaining devices, the method comprising the following steps:

providing a plurality of sheet retaining devices, each sheet retaining device having an upper member having a central longitudinal axis extending in a first direction along a length thereof, a pair of hinged leaves supported by said upper member, a plurality of ring members secured to said hinged leaves for engaging corresponding holes in sheets of material retained by the sheet retaining device, a plurality of elongated first ribs located on said upper member and extending in a first direction along said upper member, said first ribs protruding outwardly from said upper member to form a trough therebetween, and at least one pair of laterally spaced-apart elongated second ribs protruding outwardly from said upper member and extending in said first direction along said upper member, said second ribs being spaced laterally outwardly from said first ribs; and locating a first of said sheet retaining devices below a second of said sheet retaining devices such that the ring members of the second sheet retaining device engage at least one of the first or second ribs of the first sheet retaining device, wherein said first ribs are positioned on said upper member for engagement by ring members of the second sheet retaining device located thereagainst for packaging in a first arrangement, and wherein said second ribs are positioned on said upper member for engagement by ring members of the second sheet retaining device located thereagainst for packaging in a second alternative arrangement.

8. The method as set forth in claim 7, wherein the first sheet retaining device is located directly below the second sheet retaining device.

9. The method as set forth in claim 7, wherein the ring members of the first sheet retaining device engage at least one of the ribs of the second sheet retaining device.

10. The method as set forth in claim 7, further comprising the following steps:

locating a third sheet retaining device beside the first sheet retaining device; and positioning the second sheet retaining device such that the ring members of said second sheet retaining device additionally engage at least one of said ribs on said third sheet retaining device.

11. The method as set forth in claim 7, wherein the step of providing a plurality of sheet retaining devices having a plurality elongated ribs includes the following steps:

providing a pair of first ribs located symmetrically about said central longitudinal axis and extending along substantially an entire length of said upper member; and providing a plurality of pairs of second ribs spaced laterally outwardly from said first ribs, each pair of said second ribs being located on opposite longitudinal sides of said ring members.

12. The method as set forth in claim 10, wherein the ring members of said first and third sheet retaining devices also engage the ribs on said second sheet retaining device.

13. The method as set forth in claim 11, further comprising the step of positioning the second sheet retaining device directly above the first sheet retaining device such that the ring members of one of the first and second sheet retaining devices engage the pair of first ribs on the other of the first and second sheet retaining devices.

14. The method as set forth in claim 11, further comprising the following steps:

locating a third sheet retaining device beside the first sheet retaining device; and positioning the second sheet retaining device above and between said first and third sheet retaining devices such that the ring members of said second sheet retaining device engage at least one of said second ribs on said first sheet retaining device and additionally engage at least one of said second ribs on said third sheet retaining device.

15. A package of sheet retaining devices, comprising a plurality of sheet retaining devices, each sheet retaining device having an upper member having a central longitudinal axis extending in a first direction along a length thereof, a pair of hinged leaves supported by said upper member, a plurality of ring members secured to said hinged leaves for engaging corresponding holes in sheets of material retained by the sheet retaining device, a plurality of elongated first ribs located on said upper member and extending in said first direction along said upper member, said ribs protruding outwardly from said upper member to form a trough therebetween, and at least one pair of laterally spaced-apart elongated second ribs protruding outwardly from said upper member and extending in said first direction along said upper member, said second ribs being spaced laterally outwardly from said first ribs, a first of said sheet retaining devices being located below a second of said sheet retaining devices such that the ring members of the second sheet retaining device engage at least one of the first or second ribs of the first sheet retaining device, wherein said first ribs are positioned on said upper member for engagement by ring members of the second sheet retaining device located thereagainst for packaging in a first arrangement, and wherein said second ribs are positioned on said upper member for engagement by ring members of the second sheet retaining device located thereagainst for packaging in a second alternative arrangement.

16. The package as set forth in claim 15, wherein the plurality of sheet retaining devices further include a pair of first ribs located symmetrically about said central longitudinal axis and extending along substantially an entire length of said upper member, and wherein the second sheet retaining device is positioned directly above the first sheet retaining device such that the ring members of the second sheet retaining device engages the pair of first ribs on the first sheet retaining device.

17. The package as set forth in claim 15, wherein the plurality of sheet retaining devices further include a pair of first ribs located symmetrically about said central longitudinal axis and extending along substantially an entire length of said upper member, and a plurality of pairs of second ribs spaced laterally outwardly from said first ribs, each pair of said second ribs being located on opposite longitudinal sides of said ring members, and wherein said package further includes a third sheet retaining device located beside the first sheet retaining device, and wherein the second sheet retaining device is positioned above and between said first and third sheet retaining devices such that the ring members of said second sheet retaining device engage at least one of said second ribs on said first sheet retaining device and additionally engage at least one of said second ribs on said third sheet retaining device.

18. The package as set forth in claim 15, further comprising a restraining device at least partially containing the plurality of sheet retaining devices.

19. The package as set forth in claim 18, wherein the restraining device comprises a box.

* * * * *